US010974257B2

(12) United States Patent
Kersey

(10) Patent No.: US 10,974,257 B2
(45) Date of Patent: Apr. 13, 2021

(54) HYBRID-FLOTATION RECOVERY OF MINERAL BEARING ORES

(71) Applicant: CiDRA Corporate Services LLC, Wallingford, CT (US)

(72) Inventor: Alan D. Kersey, South Glastonbury, CT (US)

(73) Assignee: CiDRA Corporate Services LLC, Wallingford, CT (US)

( * ) Notice: Subject to any disclaimer, the term of this patent is extended or adjusted under 35 U.S.C. 154(b) by 112 days.

(21) Appl. No.: 16/339,475

(22) PCT Filed: Oct. 4, 2017

(86) PCT No.: PCT/US2017/055058
§ 371 (c)(1),
(2) Date: Apr. 4, 2019

(87) PCT Pub. No.: WO2018/067649
PCT Pub. Date: Apr. 12, 2018

(65) Prior Publication Data

US 2019/0232301 A1 Aug. 1, 2019

Related U.S. Application Data

(60) Provisional application No. 62/405,569, filed on Oct. 7, 2016, provisional application No. 62/403,825, filed on Oct. 4, 2016.

(51) Int. Cl.
*B03D 1/02* (2006.01)
*B03D 1/24* (2006.01)
(Continued)

(52) U.S. Cl.
CPC ..... *B03D 1/023* (2013.01); *B03D 1/025* (2013.01); *B03D 1/1418* (2013.01); *B03D 1/247* (2013.01); *B03B 5/00* (2013.01); *B03B 7/00* (2013.01)

(58) Field of Classification Search
CPC ..... B03D 1/023; B03D 1/1418; B03D 1/247; B03D 1/025; B03B 5/00; B03B 7/00
(Continued)

(56) References Cited

U.S. PATENT DOCUMENTS 8,038,012 B2 10/2011 Urizar
8,231,008 B2 7/2012 Patterson et al.
(Continued)

FOREIGN PATENT DOCUMENTS

WO 2013074150 A2 5/2013
WO WO-2013149231 A1 * 10/2013 ..... B03D 1/02
(Continued)

*Primary Examiner* — Thomas M Lithgow
(74) *Attorney, Agent, or Firm* — Ware, Fressola, Maguire & Barber LLP

(57) ABSTRACT

A flotation tank has an input to receive a slurry from a pipeline section. The slurry contains finer mineral particles and coarser mineral particles. The pipeline section has one or more loops or coiled sections arranged to perform partial centrifugal separation on the finer and coarser mineral particles. As the mineral particles are moved tangentially into the lower part of the flotation tank, the coarser mineral particles tend to be near the tank wall while the finer mineral particles tend to move into the central part of the tank. Air bubbles or lightweight synthetic bubbles are used to collect and lift the finer mineral particles to the upper part of the tank. The coarser mineral particles are recovered by using collection surfaces coated with a hydrophobic material.

20 Claims, 11 Drawing Sheets

(51) Int. Cl.

| | |
|---|---|
| ***B03B 5/00*** | (2006.01) |
| ***B03B 7/00*** | (2006.01) |
| ***B03D 1/14*** | (2006.01) |

(58) Field of Classification Search
USPC ..... 209/164, 166, 167, 170
See application file for complete search history.

(56) References Cited

U.S. PATENT DOCUMENTS

| | | | | |
|---|---|---|---|---|
| 10,245,597 | B2 * | 4/2019 | Didden ..... | B03D 1/082 |
| 2008/0251427 | A1 | 10/2008 | Mankosa et al. | |
| 2008/0308502 | A1 | 12/2008 | Jameson | |
| 2010/0200510 | A1 | 8/2010 | Domke et al. | |
| 2016/0089679 | A1 | 3/2016 | Prestes | |

FOREIGN PATENT DOCUMENTS

| | | | |
|---|---|---|---|
| WO | 2014186352 | A1 | 11/2014 |
| WO | 2018067642 | A1 | 4/2018 |

* cited by examiner

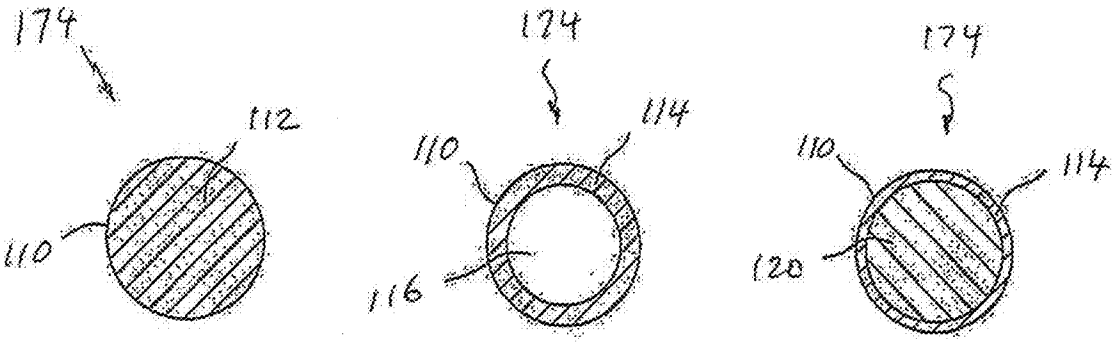
FIG. 8a
FIG. 8b
FIG. 8c
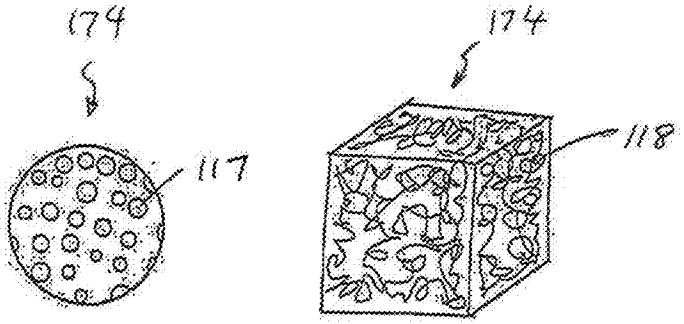
FIG. 8d
FIG. 8e

HYBRID-FLOTATION RECOVERY OF MINERAL BEARING ORES

CROSS-REFERENCE TO RELATED APPLICATIONS

This application corresponds to international application no. PCT/US17/55058, filed 4 Oct. 2017, which claims benefit to provisional application Ser. No. 62/403,825, filed 4 Oct. 2016 entitled "Hybrid P29-flotation recovery of mineral bearing ores;" and provisional patent application Ser. No. 62/405,569, filed 7 Oct. 2016, entitled "Three dimensional functionalized open-network structure for selective separation of mineral particles in an aqueous system," which are all hereby incorporated by reference in its entirety.

BACKGROUND OF THE INVENTION

1. Technical Field

This invention relates generally to a method and apparatus for separating valuable material from unwanted material in a mixture, such as a pulp slurry, or for processing mineral product for the recovery of minerals in a mineral extraction process.

2. Description of Related Art

In many industrial processes, flotation is used to separate valuable or desired material from unwanted material. By way of example, in this process a mixture of water, valuable material, unwanted material, chemicals and air is placed into a flotation cell. The chemicals are used to make the desired material hydrophobic and the air is used to carry the material to the surface of the flotation cell. When the hydrophobic material and the air bubbles collide they become attached to each other. The bubble rises to the surface carrying the desired material with it.

The performance of the flotation cell is dependent on the bubble surface area flux in the collection zone of the cell. The bubble surface area flux is dependent on the size of the bubbles and the air injection rate. Controlling the bubble surface area flux has traditionally been very difficult. This is a multivariable control problem and there are no dependable real time feedback mechanisms to use for control.

Flotation processing techniques for the separation of materials are a widely utilized technology, particularly in the fields of minerals recovery, industrial waste water treatment, and paper recycling for example.

By way of example, in the case of minerals separation the mineral bearing ore may be crushed and ground to a size, typically around 150 microns or less, such that a high degree of liberation occurs between the ore minerals and the gangue (waste) material. In the case of copper mineral extraction as an example, the ground ore is then wet, suspended in a slurry, or 'pulp', and mixed with reagents such as xanthates or other reagents, which render the copper sulfide particles hydrophobic.

Froth flotation is a process widely used for separating the valuable minerals from gangue. Flotation works by taking advantage of differences in the hydrophobicity of the mineral-bearing ore particles and the waste gangue. In this process, the pulp slurry of hydrophobic particles and hydrophilic particles is introduced to a water filled tank containing surfactant/frother which is aerated, creating bubbles. The hydrophobic particles attach to the air bubbles, which rise to the surface, forming a froth. The froth is removed and the concentrate is further refined.

Standard flotation has a number of limitations, especially in the recovery of coarse mineral particles:

- Due to the natural dynamics of the bubbles, a mineral-bearing particle may not typically be carried to the surface on one bubble, but may have to attach, be detached and re-attach to several bubbles to reach the froth layer.
- Larger particles containing minerals may not be lifted due to the limited buoyancy of a bubble, and the attractive forces between the bubble and the ore particle (created by the collector/hydrophobic chemical additives).

The above limitations restrict their effectiveness when floating coarse mineral particles. As a result, conventional flotation cells are more effective for recovery of mineral particles finer than 150-200 micron. If the particle size that could be effectively recovered in a flotation cell could be increased, the product size from grinding could be significantly increased to allow coarser particle production, the use of electrical power and process water can be reduced.

In general, 10% to 15% of the mineral bearing ore in the pulp is not recovered using air-based flotation processes, and consequently, new separation technologies are being explored and developed.

SUMMARY OF THE INVENTION

The present invention offers a solution to the above limitations of traditional mineral beneficiation. According to various embodiments of the present invention, minerals in a pulp slurry or in the tailings stream in a mineral extraction process, are recovered by applying engineered recovery media (as disclosed in commonly owned family of cases set forth below, e.g., including PCT application no. PCT/US12/39528, entitled "Flotation separation using lightweight synthetic beads or bubbles", PCT/US14/37823, entitled "Polymer surfaces having a siloxane functional group", PCT/US12/39540, entitled "Mineral separation using Sized-, Weight- or Magnetic-Based Polymer Bubbles or Bead", and PCT application no. PCT/US16/62242, entitled "Utilizing Engineered Media for Recovery of Minerals in Tailings Stream at the End of a Flotation Separation Process") in accordance with the present invention. The process and technology of the present invention circumvents the performance limiting aspects of the standard flotation process and extends overall recovery. The engineered recovery media (also referred to as engineered collection media, collection media or barren media) obtains higher recovery performance by allowing independent optimization of key recovery attributes which is not possible with the standard air bubble in conventional flotation separation.

The present invention provides a method and apparatus for the recovery of the minerals in a pulp slurry or in the tailings. In particular, the method and apparatus use a partial centrifugal separation of particle flow. After the slurry is pumped through a series of loops or coiled pipeline sections, it is moved into the lower part of a flotation cell tangentially near the cell wall. Inside the flotation cell, the finer mineral particles and the coarser mineral particles are separated and moved to different zones. The coarser mineral particles, partly due to their momentum, tend to stay near the cell wall in the zone herein referred to as an interior periphery volume. As an impeller is used to stir the slurry inside the flotation cell, the finer mineral particles are more likely to move into the center of the flotation cell in a zone herein referred to as the central volume. The finer mineral particles in the central volume can be floated using air bubbles or hydrophobic synthetic bubbles. The coarser mineral particles can be recovered using collection surfaces functionalized with hydrophobic material. The collection surfaces can be the surface structures on the inner wall of the flotation cell, one or more rotating drums, conveyor belts, filters, baskets of hydrophobic beads or the like. These collection surfaces are arranged to move into the interior periphery volume to collect the coarser mineral particles and then move into a releasing tanks where the mineral particles are stripped off the collection surfaces.

The synthetic bubbles are lightweight synthetic beads that are configured to float to the upper part of the flotation cell. They are functionalized to be hydrophobic so as to attract the minerals and to cause the finer mineral particles to attach to the surfaces of the synthetic beads. The hydrophobic synthetic bubbles or beads are also herein referred to as engineered recovery media, engineered collection media, mineral collection media, collection media or barren media. The synthetic bubbles or beads can be polymer shells, typically made of a polymeric base material and coated with a hydrophobic material. In other words, the polymeric base material is modified to make the surface of the polymer attractive to the mineral of interest—either through hydrophobic attraction, or other chemical linkage to the collectors on the mineral particles. In this process, minerals attach to the polymer shells and separation is achieved via flotation of these 'engineered bubbles'. This approach/system exhibits a higher degree of robustness than conventional air-bubble flotation. Alternatively, the polymer is used to form, or coat plates, or belts, in which case the mineral particles adhere to the surfaces, and on removal from a cell, the bound mineral can be washed off (with the release being chemically triggered—e.g., pH for example), or mechanically released (e.g., vibration/ultrasonically for example). According to some embodiments, and by way of example, the synthetic bubbles or beads may have a substantially spherical or cubic shape, consistent with that set forth herein, although the scope of the invention is not intended to be limited to any particular type or kind of geometric shape. The term "loaded", when used in conjunction with the collection media, means having mineral particles attached to the surface and the term "unloaded" means having mineral particles stripped from the surface.

The synthetic bubbles or beads can also be made of an open-cell foam.

The collection surfaces arranged to recover the coarse mineral particles can be conveyor belts made of polyurethane or other pliable synthetic materials; filters or liners made of soft or hard plastic having surface features to trap the mineral particles, or made of an open-cell foam. The synthetic bubbles or beads and the collection surfaces are coated with a chemical selected from the group consisting of polysiloxanes, poly(dimethylsiloxane), hydrophobically-modified ethyl hydroxyethyl cellulose, polysiloxanates, alkylsilane and fluoroalkylsilane.

By way of example, the coating may include a silicone gel that includes, or takes the form of, molecules having the siloxane functional group, including a siloxane that is, or takes the form of, a functional group in organosilicon chemistry with the Si—O—Si linkage.

Parent siloxanes may include, or take the form of, oligomeric and polymeric hydrides with the formulae $H(OSiH_2)_nOH$ and $(OSiH_2)_n$.

The siloxane may include branched compounds, where the defining feature includes each pair of silicon centers being separated by one oxygen atom.

The silicone gel may take the form of a product sold in a combination that includes 3-4222 Dielectric Firm Gel Part A and 3-4222 Dielectric Firm Gel Part B.

The silicone gel may come with two parts, including:

Part A that includes dimethyl siloxane, dimethylvinyl-terminated—68083-19-2; polydimethylsiloxane—63148-62-9; reaction of ethylene glycol and silica—170424-65-4; hydrotreated light naphthenic petroleum distillate—64742-53-6; and Part B that includes dimethyl siloxane, dimethylvinyl-terminated—68083-19-2; polydimethylsiloxane—63148-62-9; dimethyl siloxane, hydrogen-terminated—none; trimethylated silica—68909-20-6; dimethyl, methylhydrogen siloxane—68037-59-2.

The coating may be configured or made substantially of a material that consists of a siloxane-based material in a non-gel form.

Thus, the first aspect of the present invention provides an apparatus, comprising a flotation tank having an input arranged to receive a slurry, the slurry comprises finer mineral particles and coarser mineral particles;

a plurality of bubbles arranged to attract the finer mineral particles for providing enriched bubbles having finer mineral particles attached thereon; and one or more collection surfaces, the collection surfaces functionalized to be hydrophobic to attract the coarser mineral particles, wherein the flotation tank comprises a tank wall and an interior periphery volume near the tank wall, and the plurality of collection surfaces are disposed in the interior periphery volume to attract the coarser mineral particles.

According to an embodiment of the present invention, the flotation tank comprises a lower part and an upper part, wherein the input is located in the lower part of the flotation tank and arranged to receive the slurry tangentially to the tank wall, the apparatus further comprising a conduit loop having a first conduit end and a second conduit end, the first conduit end arranged to receive the slurry and the second conduit end arranged to provide the slurry to the input of the flotation tank.

According to an embodiment of the present invention, the plurality of bubbles comprise air bubbles, said apparatus further comprising an aerator apparatus configured to provide the air bubbles in the lower part of the flotation tank; and an outlet near the upper part of the flotation tank, the outlet arranged to remove the enriched bubbles from the flotation tank.

According to an embodiment of the present invention, the plurality of bubbles comprise synthetic bubbles having a hydrophobic surface to attract the finer mineral particles, said synthetic bubbles having a specific gravity smaller than the slurry and wherein the enriched bubbles comprise enriched synthetic bubbles having finer mineral particles attached thereon, and an outlet near the upper part of the flotation tank, the outlet arranged to remove the enriched bubbles from the flotation tank.

According to an embodiment of the present invention, the flotation tank further comprises a central volume surrounded by the interior periphery volume, and wherein the received slurry through the input of the flotation tank has a first slurry part and a second slurry part, the central volume comprising the first slurry part, the interior periphery volume the second slurry part, the first slurry part comprising the finer mineral particle, the second slurry part comprising the coarser mineral particles.

According to an embodiment of the present invention, the flotation tank further comprises a dividing structure located near the input, the dividing structure arranged to direct the first slurry part to the central volume, and the second slurry part to the interior periphery volume.

According to an embodiment of the present invention, the collection surfaces comprise wall structures located on an interior side of the tank wall, the wall structures having a surface coated with a hydrophobic material.

According to an embodiment of the present invention, the collection surfaces comprise a layer of foam coated with a hydrophobic material.

According to an embodiment of the present invention, the collection surfaces comprise one or more conveyor belts having a belt surface coated with a hydrophobic material to attract the coarser mineral particles, wherein each of said one or more conveyor belts is arranged to move through the interior periphery volume to collect the coarser mineral particles on the belt surface; to move to a release tank having a releasing agent configured to strip the coarser mineral particles from the belt surface, and to move through the interior periphery volume again.

According to an embodiment of the present invention, the collection surfaces comprise one or more baskets having beads coated with a hydrophobic material to attract the coarser mineral particles, wherein each of said one or more baskets is arranged to move through the interior periphery volume to collect the coarser mineral particles on the beads; to move to a release tank having a releasing agent configured to strip the coarser mineral particles from the beads, and to move through the interior periphery volume again.

According to an embodiment of the present invention, the collection surfaces comprise one or more baskets having filters coated with a hydrophobic material to attract the coarser mineral particles, wherein each of said one or more baskets is arranged to move through the interior periphery volume to collect the coarser mineral particles on the filters; to move to a release tank having a releasing agent configured to strip the coarser mineral particles from the beads, and to move through the interior periphery volume again.

According to an embodiment of the present invention, the collection surfaces are coated with a chemical selected from the group consisting of polysiloxanes, poly(dimethylsiloxane), hydrophobically-modified ethyl hydroxyethyl cellulose, polysiloxanates, alkylsilane and fluoroalkylsilane.

According to an embodiment of the present invention, the synthetic bubbles are coated with a chemical selected from the group consisting of polysiloxanes, poly(dimethylsiloxane), hydrophobically-modified ethyl hydroxyethyl cellulose, polysiloxanates, alkylsilane and fluoroalkylsilane.

According to an embodiment of the present invention, the synthetic bubbles are made of an open-cell foam.

The second aspect of the present invention is a method, comprising:

proving a flotation tank having a slurry input arranged to receive a slurry, the slurry comprises finer mineral particles and coarser mineral particles; a bubble input arranged to receive a plurality of bubbles arranged to attract the finer mineral particles for providing enriched bubbles having finer mineral particles attached thereon, the flotation tank comprising a lower part and an upper part, wherein the slurry input is located in the lower part of the flotation tank and arranged to receive the slurry tangentially to the tank wall, proving one or more collection surfaces, the collection surfaces functionalized to be hydrophobic to attract the coarser mineral particles, wherein the flotation tank comprises a tank wall and an interior periphery volume near the tank wall, and the plurality of collection surfaces are disposed in the interior periphery volume to attract the coarser mineral particles, and arranging a conduit loop having a first conduit end and a second conduit end, the first conduit end arranged to receive the slurry and the second conduit end arranged to provide the slurry to the input of the flotation tank.

According to an embodiment of the present invention, the plurality of bubbles comprise air bubbles, the method further comprising providing an aerator apparatus configured to provide the air bubbles in the lower part of the flotation tank; and arranging an outlet near the upper part of the flotation tank, the outlet arranged to remove the enriched bubbles from the flotation tank.

According to an embodiment of the present invention, the plurality of bubbles comprise synthetic bubbles having a hydrophobic surface to attract the finer mineral particles, said synthetic bubbles having a specific gravity smaller than the slurry and wherein the enriched bubbles comprise enriched synthetic bubbles having finer mineral particles attached thereon, the method further comprising arranging an outlet near the upper part of the flotation tank, the outlet arranged to remove the enriched bubbles from the flotation tank.

BRIEF DESCRIPTION OF THE DRAWINGS

FIGS. 8*a*-8*e* illustrate a synthetic bead with different shapes and structures.

DETAILED DESCRIPTION OF THE INVENTION

FIGS. 1, 1A, 2, 3, 3A, 4, 5, 5A and 6

The present invention provides a method and apparatus that use a partial centrifugal separation of particle flow. FIG.

Figure 1:
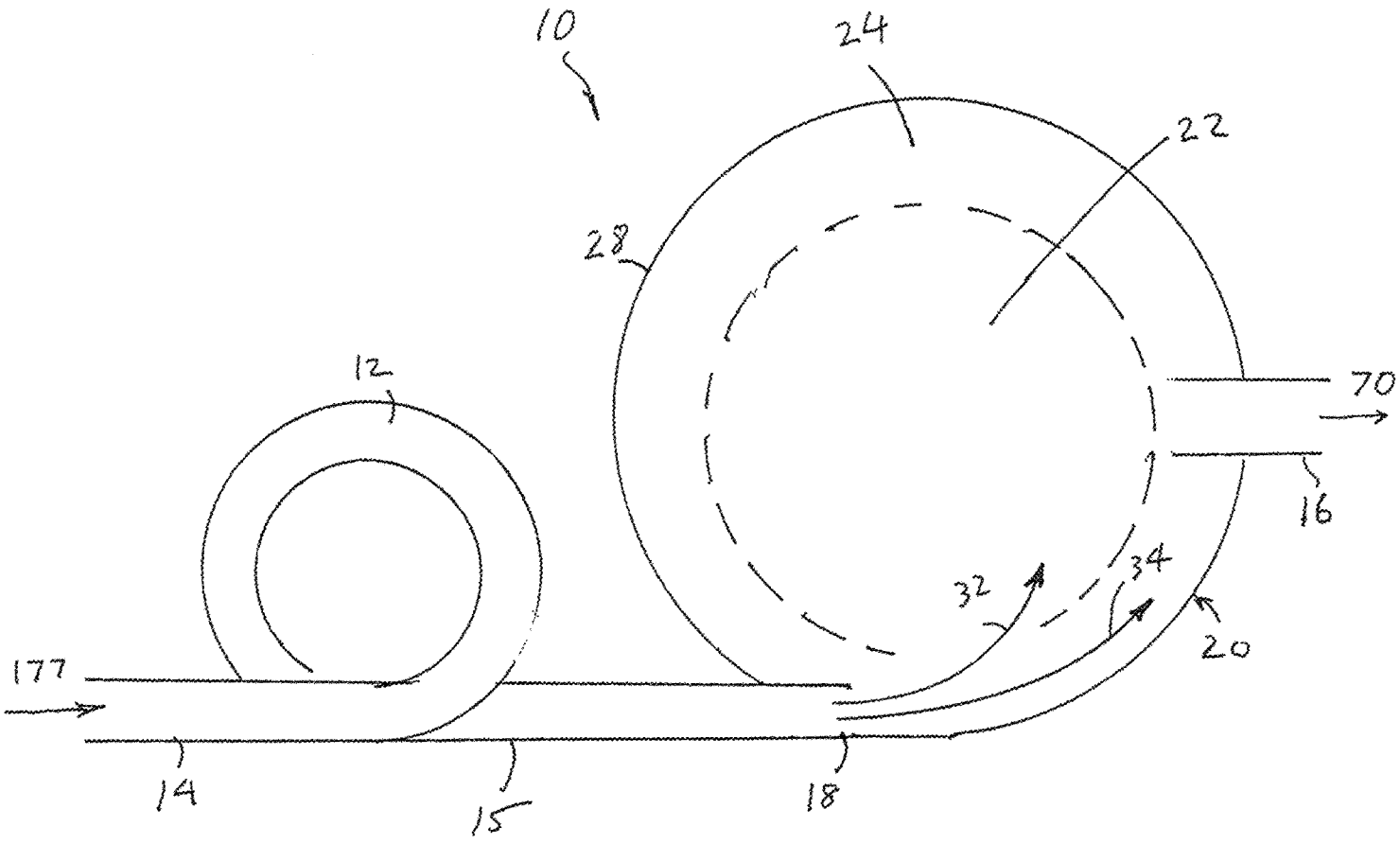
FIG. 1 illustrates the operation principle of the present invention.

1 illustrates the operation principle of the present invention. According to an embodiment of the present invention, a flotation tank or cell is arranged to float the mineral particles in a slurry. The flotation tank has an input arranged to receive the slurry from a pipeline section. The pipeline section has one or more loops to partially separate the finer mineral particles from the coarser mineral particles by centrifugal forces. As seen in FIG. 1, the apparatus 10 of the present invention comprises a flotation tank 20. In the lower part of the flotation tank 20, an input 18 is arranged to receive a slurry 177 from a pipeline section 15. The pipeline section 15 has a feed input 14 arranged to receive the slurry 177 and one or more loops or coiled sections 12. The flotation tank 20 has a tank wall 28. Within the tank wall 28, the tank volume has a central volume 22 and an interior periphery volume 24. The slurry 177 is moved into the flotation tank 20 through the input 18 tangentially near the tank wall 28 in the lower part of the tank. Inside the flotation tank 20, the finer mineral particles may follow a flow path 32 into the central volume 22 and the coarser mineral particles may follow a flow part 34 into the interior periphery volume 24. The finer mineral particles in the central volume 22 can be recovered through bubble flotation and removed through outlet 16 as froth 70.

Figure 1A:
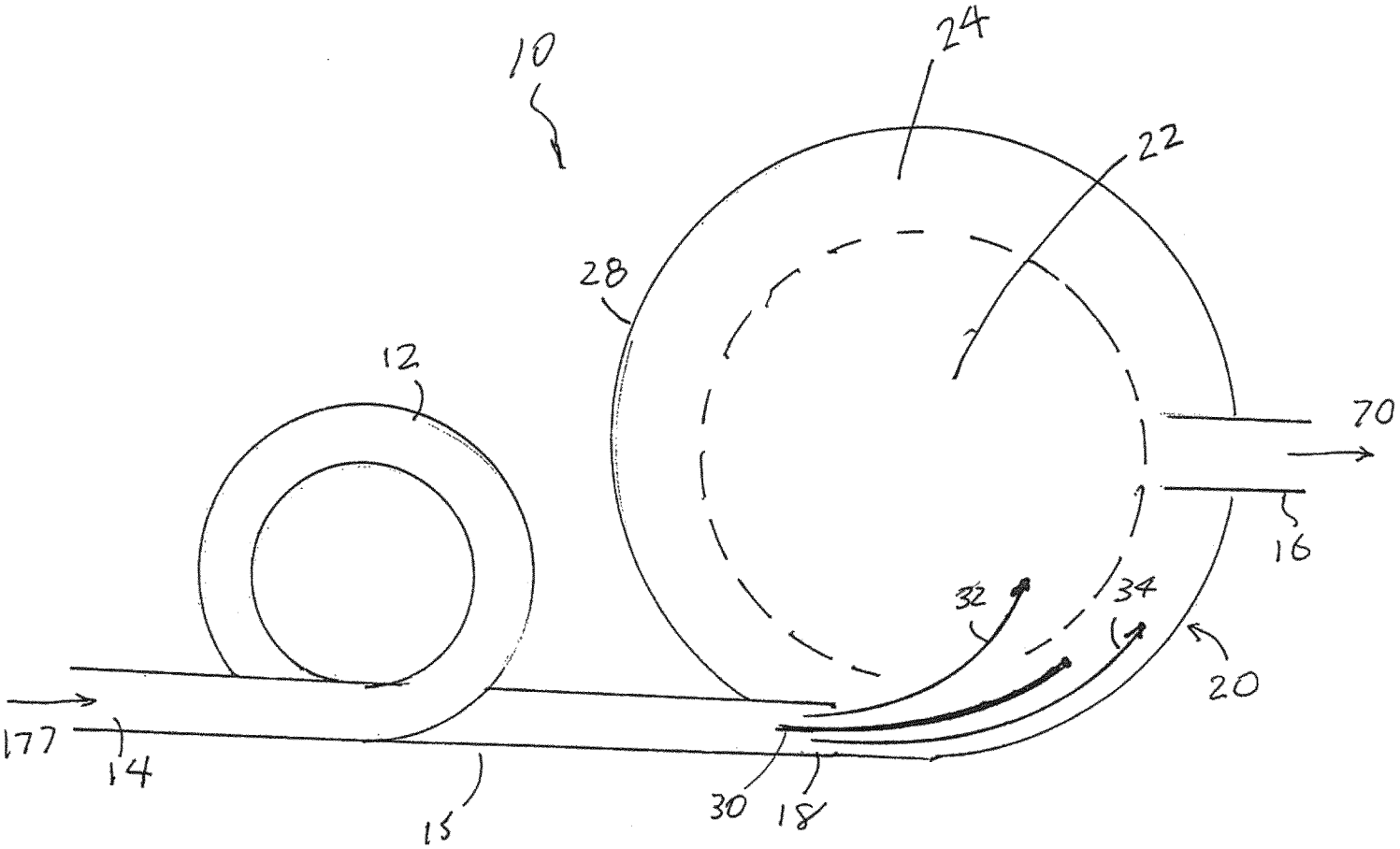
FIG. 1A illustrates the apparatus, according to an embodiment of the present invention.

In an embodiment of the present invention, a bifurcation structure 30 is disposed near the input 18 as shown in FIG. 1A. The bifurcation structure 30 is configured to guide the finer mineral particles to the central volume 22 and to guide the coarser mineral particles to the interior periphery volume 24.

Figure 2:
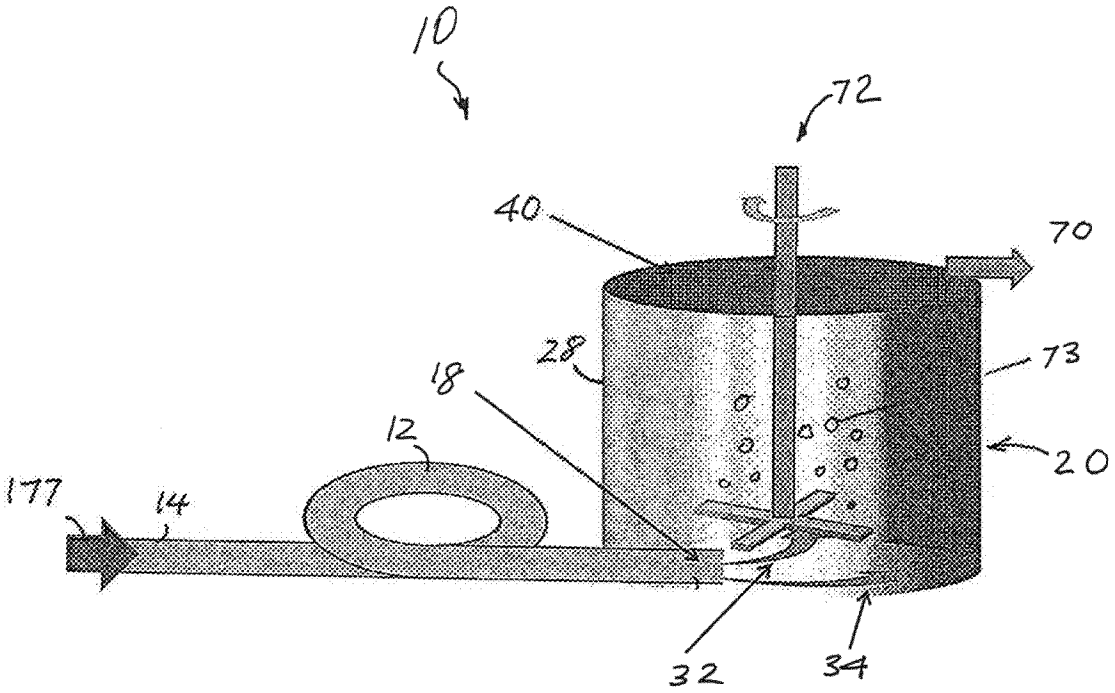
FIG. 2 illustrates the apparatus having a flotation tank, according to an embodiment of the present invention.

FIG. 2 illustrates the recovery of the finer mineral particles and the coarser mineral particles in different fashions. As seen in FIG. 2, the apparatus 10 has an aeration device 72 disposed in the central part of the flotation tank 20 to introduce air bubbles 73 for driving the flotation process. As the finer mineral particles are attached to the air bubbles 73, they float to the upper portion of the flotation tank 20 to form a froth layer or froth 70. Froth flotation is known in the art. According to an embodiment of the present invention, the interior side of the tank wall 28 comprises a wall structure 40 to capture the coarser mineral particles. The wall structure 40 may include bumps and grooves coated with a hydrophobic material. The wall structure 40 may comprise a layer of open-cell foam, for example. The foam is also coated with a hydrophobic material. The hydrophobic material can be selected from the group consisting of polysiloxanes, poly(dimethylsiloxane), hydrophobically-modified ethyl hydroxyethyl cellulose, polysiloxanates, alkylsilane and fluoroalkylsilane, for example.

Figure 3A:
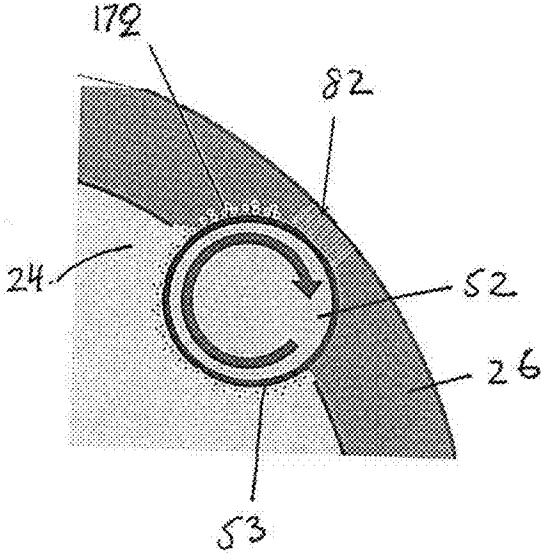
FIGS. 3 and 3A illustrate a system for recovering the coarser mineral particles, according to an embodiment of the present invention.
Figure 3:
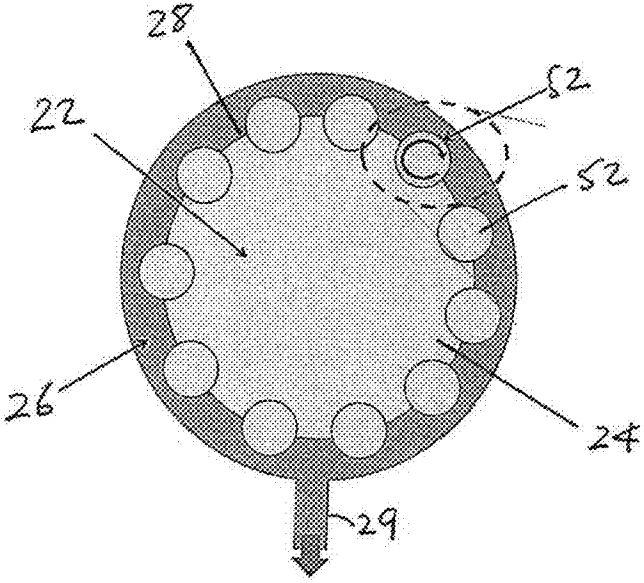

According to an embodiment of the present invention, the coarser mineral particles in the interior periphery volume 24 can be recovered by using a plurality of rotors or rotating drums 52 located near the interior periphery volume 24. Part of the cylindrical surface of the drum 52 is exposed to the outside of the tank wall 28 as shown in FIGS. 3 and 3A. The surface 53 of the drum 52 is coated with a hydrophobic material to attract the mineral particles inside the tank. The rotating drums 52 are arranged to rotate so that the mineral particles 172 attached to the drum surface 53 can be stripped off by a brush 82 in a release compartment 26.

Figure 4:
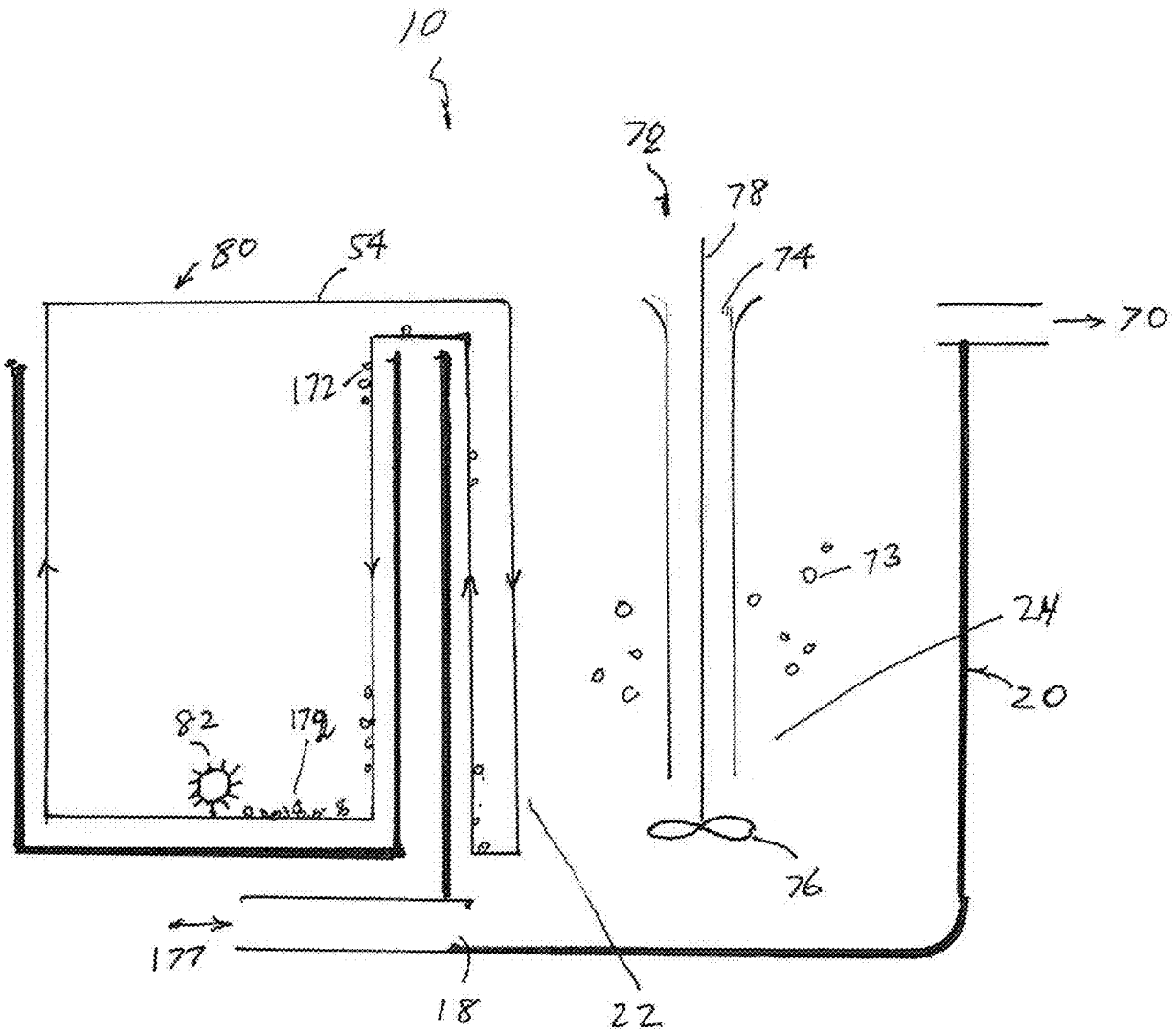
FIG. 4 illustrates the apparatus, according to an embodiment of the present invention.

According to an embodiment of the present invention, the coarser mineral particles in the interior periphery volume 22 are recovered by using one or more conveyor belts 54 as shown in FIG. 4. As illustrated in FIG. 4, conveyor belt 54 coated with a hydrophobic material is arranged to move into the interior periphery volume 22 of the flotation tank 20 in order to collect mineral particles 172 on the surface of conveyor belt 54. The conveyor belt 54 is then moved to a release tank 80 which has a stripping agent and a brush 82 to brush off the mineral particles 172 from the surface of conveyor belt 54. Also illustrated in FIG. 4 is an aeration device 72 which has an air inlet 74 to introduce air into the tank. An impeller 76 rotated by an impeller shaft 78 is arranged to provide air bubbles 73.

Figure 5:
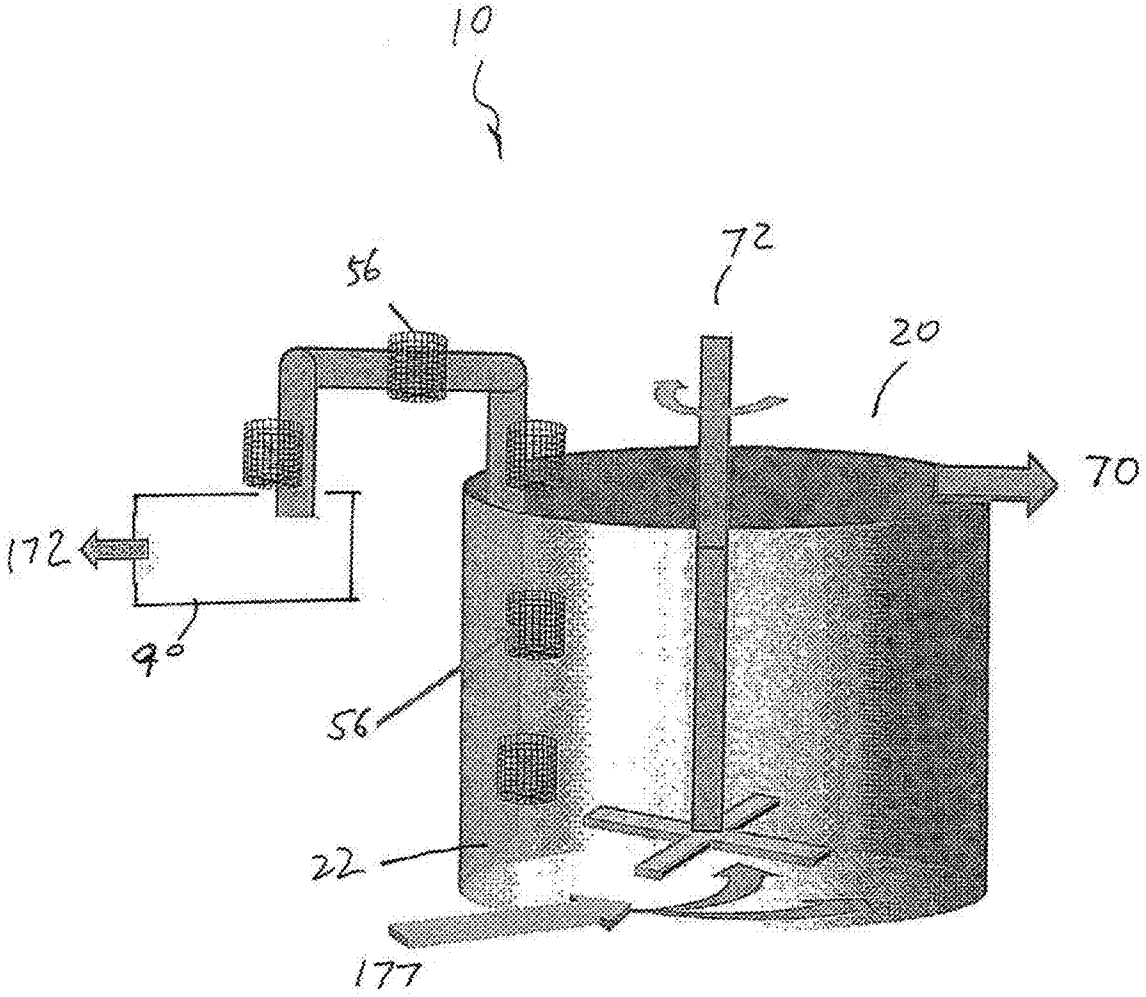
FIG. 5 illustrates another system for recovering the coarser mineral particles, according to an embodiment of the present invention.

According to an embodiment of the present invention, the apparatus 10 has a plurality of cages or baskets 56 which are arranged to move into the interior periphery volume 22 to collect the mineral particles as shown in FIG. 5. The baskets 56 may contain synthetic beads 174 (see FIGS. 8*a*-8*e*, 9*a*-9*d*). After moving through the slurry in the interior periphery volume 22, the baskets 56 are removed from the flotation tank 20 and moved to a cleaning/recovery unit 90 where the mineral particles 172 are stripped off the synthetic beads 174. The synthetic beads 174 can be cleaned and reused.

Figure 5A:
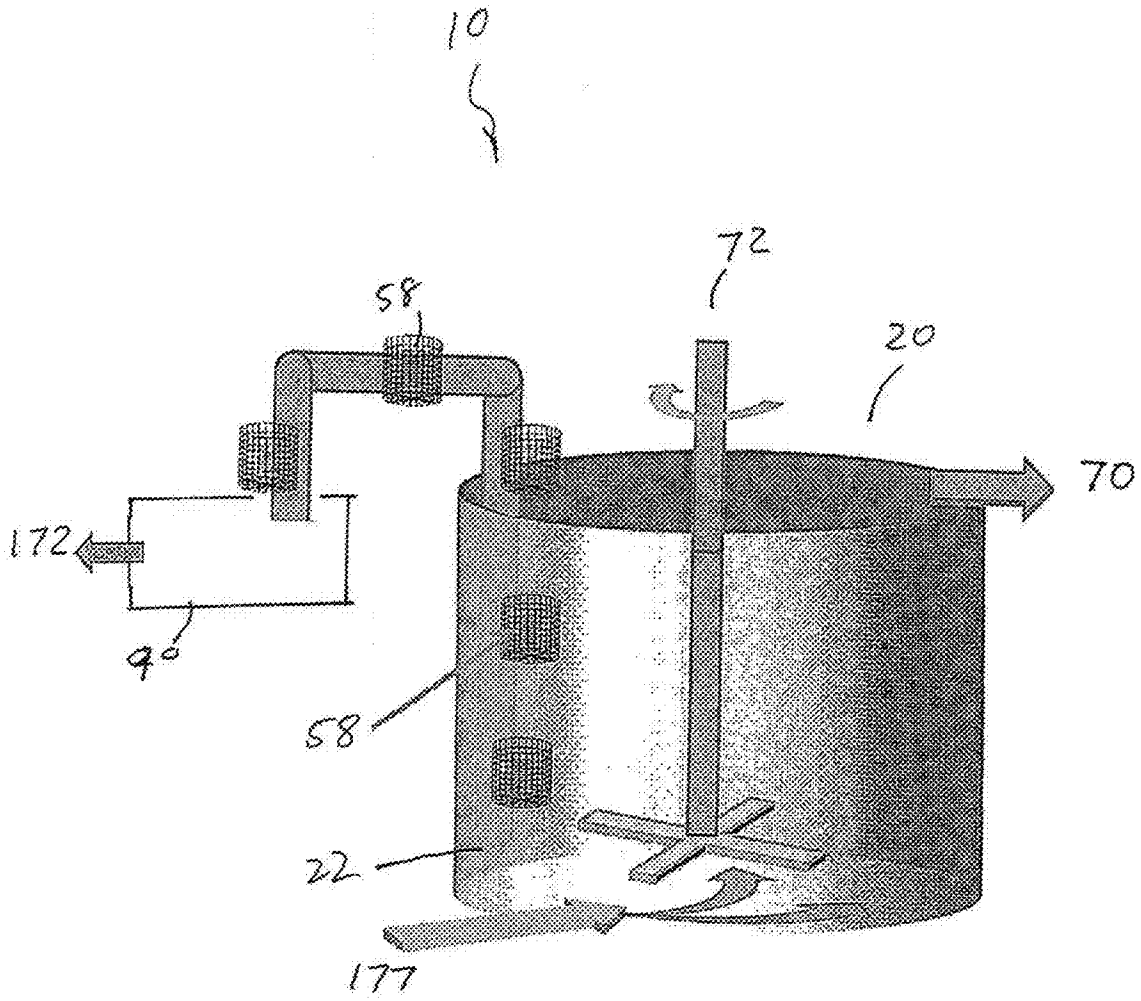
FIG. 5A illustrates yet another system for recovering the coarser miner particles, according to an embodiment of the present invention.

According to an embodiment of the present invention, the apparatus 10 has a plurality of filters 58 which can be moved into the interior periphery volume 22 to collect the mineral particles as shown in FIG. 5A. The filters 58 are coated with a hydrophobic material to attract mineral particles. The filters can be made from a porous material 117 as shown in FIG. 8*a* or an open-cell foam 118 as shown in FIG. 8*e*. After moving through the slurry in the interior periphery volume 22, the filters 58 are removed from the flotation tank 20 and moved to a cleaning/recovery unit 90 where the mineral particles 172 are stripped off the filters 58. The filters 58 can be cleaned and reused.

Figure 6:
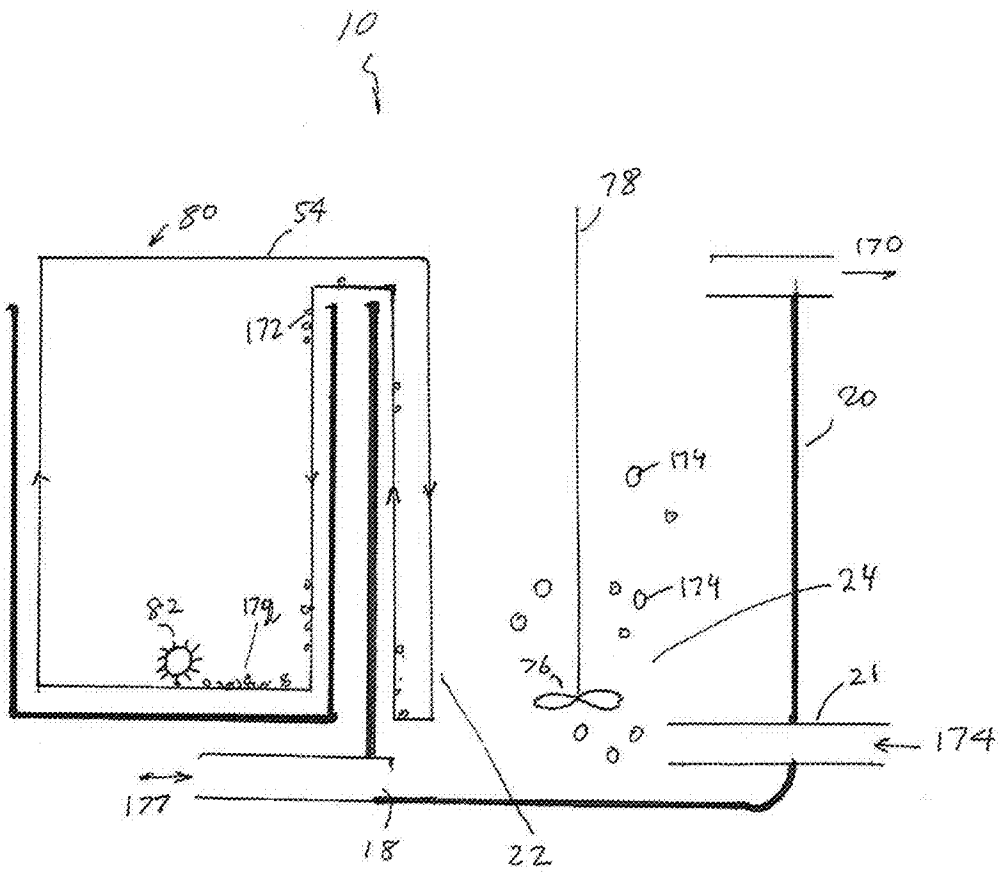
FIG. 6 illustrates the apparatus, according to another embodiment of the present invention.

According to an embodiment of the present invention, the finer mineral particles can also be recovered by using synthetic bubbles or lightweight synthetic beads 174 as shown in FIG. 6. As shown in FIG. 6, the flotation tank 20 has an input 21 to receive synthetic beads 174. The synthetic beads 174 are configured to be buoyant in the flotation tank. With the aid of the impeller 76, the finer mineral particles in the central volume 24 are attached to the synthetic beads 174 and float to the upper part of the tank. The loaded synthetic beads 170 having mineral particles 172 attached thereon (see FIGS. 7A and 7B) are directed to a release stage where mineral particles 172 are recovered.

FIGS. 7*a*, 7*b*, 8*a*-8*e* and 9*a*-9*d*

Figure 7B:
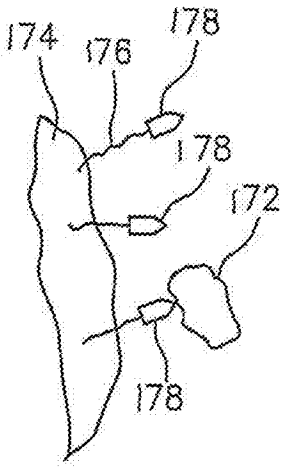
FIG. 7*b* illustrates part of a loaded bead having molecules to attract mineral particles.
Figure 7A:
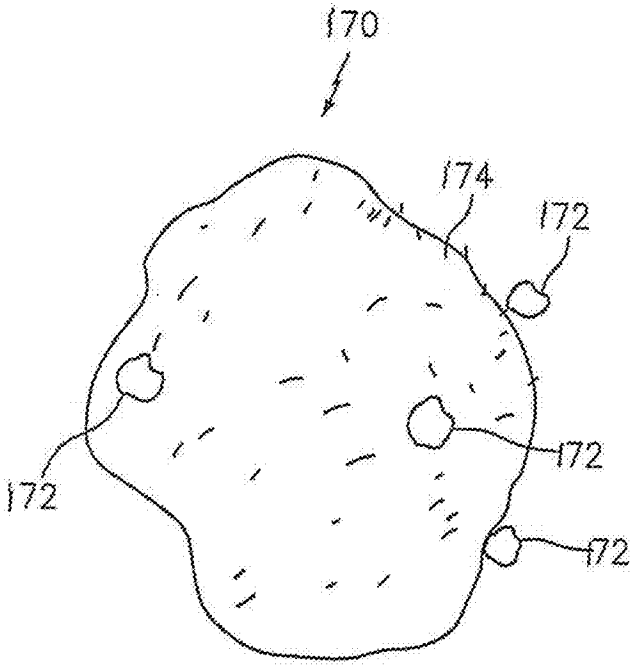
FIG. 7*a* illustrates a mineral laden synthetic bead, or loaded bead.

FIG. 7*a* illustrates a mineral laden synthetic bead, or loaded bead 170. As illustrated, a synthetic bead 174 can attract many mineral particles 172. FIG. 7*b* illustrates part of a loaded bead having molecules (176, 178) to attract mineral particles.

As shown in FIGS. 7*a* and 7*b*, the synthetic bead 174 has a bead body to provide a bead surface. At least the outside part of the bead body is made of a synthetic material, such as polymer, so as to provide a plurality of molecules or molecular segments 176 on the surface of the bead 174. The molecule 176 is used to attach a chemical functional group 178 to the surface 175 of bead 174. In general, the molecule 176 can be a hydrocarbon chain, for example, and the functional group 178 can have an anionic bond for attracting or attaching a mineral, such as copper to the surface. A xanthate, for example, has both the functional group 178 and the molecular segment 176 to be incorporated into the polymer that is used to make the synthetic bead 174. A functional group 178 is also known as a collector that is either ionic or non-ionic. The ion can be anionic or cationic. An anion includes oxyhydryl, such as carboxylic, sulfates and sulfonates, and sulfhydral, such as xanthates and dithiophosphates. Other molecules or compounds that can be used to provide the function group 178 include, but are not limited to, thionocarboamates, thioureas, xanthogens, monothiophosphates, hydroquinones and polyamines. Similarly, a chelating agent can be incorporated into or onto the polymer as a collector site for attracting minerals. As shown in FIG. 7*b*, a mineral particle 172 is attached to the functional group 178 on a molecule 176. In general, the mineral particle 172 is much smaller than the synthetic bead 174. Many mineral particles 172 can be attracted to or attached to the surface of a synthetic bead 174.

In some embodiments of the present invention, a synthetic bead has a solid-phase body made of a synthetic material, such as polymer. The polymer can be rigid or elastomeric. An elastomeric polymer can be polyisoprene or polybutadiene, for example. The synthetic bead 174 has a bead body 110 having a surface comprising a plurality of molecules with one or more functional groups for attracting mineral particles to the surface. A polymer having a functional group to collect mineral particles is referred to as a functionalized polymer. In one embodiment, the entire interior part 112 of the body 110 of the synthetic bead 174 is made of the same functionalized material, as shown in FIG. 8*a*. In another embodiment, the bead body 110 comprises a shell 114. The shell 114 can be formed by way of expansion, such as thermal expansion or pressure reduction. The shell 114 can be a micro-bubble or a balloon. In FIG. 8*b*, the shell 114, which is made of functionalized material, has an interior part 116. The interior part 116 can be filled with air or gas to aid buoyancy, for example. The interior part 116 can be used to contain a liquid to be released during the mineral separation process. The encapsulated liquid can be a polar liquid or a non-polar liquid, for example. The encapsulated liquid can contain a depressant composition for the enhanced separation of copper, nickel, zinc, lead in sulfide ores in the flotation stage, for example. The shell 114 can be used to encapsulate a powder which can have a magnetic property so as to cause the synthetic bead to be magnetic, for example. The encapsulated liquid or powder may contain monomers, oligomers or short polymer segments for wetting the surface of mineral particles when released from the beads. For example, each of the monomers or oligomers may contain one functional group for attaching to a mineral particle and an ion for attaching the wetted mineral particle to the synthetic bead. The shell 84 can be used to encapsulate a solid core, such as Styrofoam to aid buoyancy, for example. In yet another embodiment, only the coating of the bead body is made of functionalized polymer. As shown in FIG. 8*c*, the synthetic bead has a core 120 made of ceramic, glass or metal and only the surface of core 120 has a coating or shell 114 made of functionalized polymer. The core 120 can be a hollow core or a filled core depending on the application. The core 120 can be a micro-bubble, a sphere or balloon. For example, a filled core made of metal makes the density of the synthetic bead to be higher than the density of the pulp slurry, for example. The core 120 can be made of a magnetic material so that the para-, ferri-, ferro-magnetism of the synthetic bead is greater than the para-, ferri-, ferro-magnetism of the unwanted ground ore particle in the mixture. In a different embodiment, the synthetic bead can be configured with a ferro-magnetic or ferri-magnetic core that attract to paramagnetic surfaces. A core 120 made of glass or ceramic can be used to make the density of the synthetic bead substantially equal to the density of the pulp slurry so that when the synthetic beads are mixed into the pulp slurry for mineral collection, the beads can be in a suspension state.

According to a different embodiment of the present invention, the synthetic bead 174 can be a porous block 117 or take the form of a sponge or foam with multiple segregated gas filled chambers as shown in FIGS. 8*d* and 8*e*. FIG. 8*e* illustrates a synthetic bead 174 made from a foam block 118. The foam block 118 can be made of an open-cell foam as described in the Summary.

It should be understood that the term "bead" does not limit the shape of the synthetic bead of the present invention to be spherical, as shown in FIGS. 8*a*-8*d*. In some embodiments of the present invention, the synthetic bead 174 can have an elliptical shape, a cylindrical shape, a shape of a block. Furthermore, the synthetic bead can have an irregular shape.

Figure 9A:
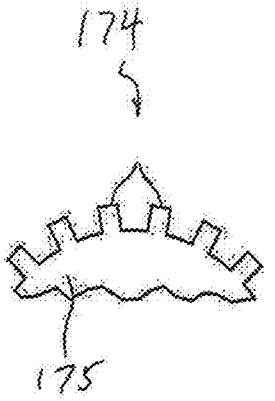
FIGS. 9*a*-9*d* illustrate various surface features on a synthetic bead to increase the collection area.
Figure 9B:
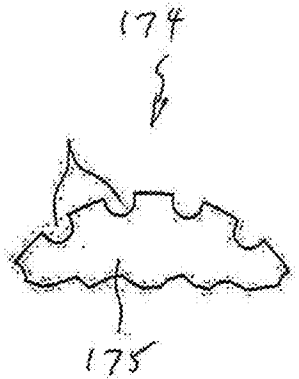
Figure 9C:
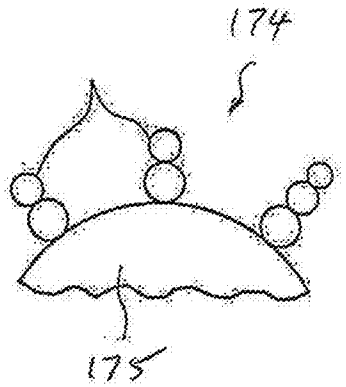
Figure 9D:
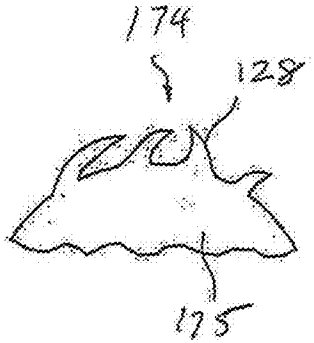

It should also be understood that the surface of a synthetic bead, according to the present invention, is not limited to an overall smooth surface as shown in FIGS. 8*a*-8*e*. In some embodiments of the present invention, the surface can be irregular and rough. For example, the surface of the bead 174 can have some physical structures 122 like grooves or rods as shown in FIG. 9*a*. The surface 175 of bead 174 can have some physical structures 124 like holes or dents as shown in FIG. 9*b*. The surface 175 of bead 174 can have some physical structures 126 formed from stacked beads as shown in FIG. 9*c*. The surface 174 can have some hair-like physical structures 128 as shown in FIG. 9*d*. In addition to the functional groups on the synthetic beads that attract mineral particles to the bead surface, the physical structures can help trapping the mineral particles on the bead surface. The surface of bead 174 can be configured to be a honeycomb surface or sponge-like surface for trapping the mineral particles and/or increasing the contacting surface.

It should also be noted that the synthetic beads of the present invention can be realized by a different way to achieve the same goal. Namely, it is possible to use a different means to attract the mineral particles to the surface of the synthetic beads. For example, the surface of the polymer beads, shells can be functionalized with a hydrophobic chemical molecule or compound. The synthetic beads and/or engineered collection media can be made of a polymer. The term "polymer" in this specification means a large molecule made of many units of the same or similar structure linked together. Furthermore, the polymer can be naturally hydrophobic or functionalized to be hydrophobic. Some polymers having a long hydrocarbon chain or silicon-oxygen backbone, for example, tend to be hydrophobic. Hydrophobic polymers include polystyrene, poly(d,l-lactide), poly(dimethylsiloxane), polypropylene, polyacrylic, polyethylene, etc. The bubbles or beads, such as synthetic bead 170 can be made of glass to be coated with hydrophobic silicone polymer including polysiloxanates so that the bubbles or beads become hydrophobic. The bubbles or beads can be made of metal to be coated with silicone alkyd copolymer, for example, so as to render the bubbles or beads hydrophobic. The bubbles or beads can be made of ceramic to be coated with fluoroalkylsilane, for example, so as to render the bubbles and beads hydrophobic. The bubbles or beads can be made of hydrophobic polymers, such as polystyrene and polypropylene to provide a hydrophobic surface. The wetted mineral particles attached to the hydrophobic synthetic bubble or beads can be released thermally, ultrasonically, electromagnetically, mechanically or in a low pH environment.

The multiplicity of hollow objects, bodies, elements or structures may include hollow cylinders or spheres, as well as capillary tubes, or some combination thereof. The scope of the invention is not intended to be limited to the type, kind or geometric shape of the hollow object, body, element or structure or the uniformity of the mixture of the same.

In general, the mineral processing industry has used flotation as a means of recovering valuable minerals. This process uses small air bubbles injected into a cell containing the mineral and slurry whereby the mineral attaches to the bubble and is floated to the surface. This process leads to separating the desired mineral from the gangue material. Alternatives to air bubbles have been proposed where small spheres with proprietary polymer coatings are instead used. This disclosure proposes a new and novel media type with a number of advantages.

One disadvantage of spherical shaped recovery media such as a bubble, is that it possesses a poor surface area to volume ratio. Surface area is an important property in the mineral recovery process because it defines the amount of mass that can be captured and recovered. High surface area to volume ratios allows higher recovery per unit volume of media added to a cell. As illustrated in FIG. 8*e*, open-cell foam and sponge-like material can be used as an engineered collection media. Open cell or reticulated foam offers an advantage over other media shapes such as the sphere by having higher surface area to volume ration. Applying a functionalized polymer coating that promotes attachment of mineral to the foam "network" enables higher recovery rates and improved recovery of less liberated mineral when compared to the conventional process. For example, open cells allow passage of fluid and particles smaller than the cell size but capture mineral bearing particles that come in contact with the functionalized polymer coating. Selection of cell size is dependent upon slurry properties and application.

The coated foam may be cut in a variety of shapes and forms. For example, a polymer coated foam belt can be moved through the slurry to collect the desired minerals and then cleaned to remove the collected desired minerals. The cleaned foam belt can be reintroduced into the slurry. Strips, blocks, and/or sheets of coated foam of varying size can also be used where they are randomly mixed along with the slurry in a mixing cell. The thickness and cell size of a foam can be dimensioned to be used as a cartridge-like filter which can be removed, cleaned of recovered mineral, and reused.

As mentioned earlier, the open cell or reticulated foam, when coated or soaked with hydrophobic chemical, offers an advantage over other media shapes such as sphere by having higher surface area to volume ratio. Surface area is an important property in the mineral recovery process because it defines the amount of mass that can be captured and recovered. High surface area to volume ratios allows higher recovery per unit volume of media added to a cell.

The open cell or reticulated foam provides functionalized three dimensional open network structures having high surface area with extensive interior surfaces and tortuous paths protected from abrasion and premature release of attached mineral particles. This provides for enhanced collection and increased functional durability. Spherical shaped recovery media, such as beads, and also of belts, and filters, is poor surface area to volume ratio—these media do not provide high surface area for maximum collection of minerals. Furthermore, certain media such as beads, belts and filters may be subject to rapid degradation of functionality.

Applying a functionalized polymer coating that promotes attachment of mineral to the foam "network" enables higher recovery rates and improved recovery of less liberated mineral when compared to the conventional process. This foam is open cell so it allows passage of fluid and particles smaller than the cell size but captures mineral bearing particles that come in contact with the functionalized polymer coating. Selection of cell size is dependent upon slurry properties and application.

A three-dimensional open cellular structure optimized to provide a compliant, tacky surface of low energy enhances collection of hydrophobic or hydrophobized mineral particles ranging widely in particle size. This structure may be comprised of open-cell foam coated with a compliant, tacky polymer of low surface energy. The foam may be comprised of reticulated polyurethane or another appropriate open-cell foam material such as silicone, polychloroprene, polyisocyanurate, polystyrene, polyolefin, polyvinylchloride, epoxy, latex, fluoropolymer, phenolic, EPDM, nitrile, composite foams and such. The coating may be a polysiloxane derivative such as polydimethylsiloxane and may be modified with tackifiers, plasticizers, crosslinking agents, chain transfer agents, chain extenders, adhesion promoters, aryl or alky copolymers, fluorinated copolymers, hydrophobizing agents such as hexamethyldisilazane, and/or inorganic particles such as silica or hydrophobic silica. Alternatively, the coating may be comprised of materials typically known as pressure sensitive adhesives, e.g. acrylics, butyl rubber, ethylene vinyl acetate, natural rubber, nitriles; styrene block copolymers with ethylene, propylene, and isoprene; polyurethanes, and polyvinyl ethers as long as they are formulated to be compliant and tacky with low surface energy.

The three-dimensional open cellular structure may be coated with a primer or other adhesion agent to promote adhesion of the outer collection coating to the underlying structure.

In addition to soft polymeric foams, other three-dimensional open cellular structures such as hard plastics, ceramics, carbon fiber, and metals may be used. Examples include metal and ceramic foams and porous hard plastics such as polypropylene honeycombs and such. These structures must be similarly optimized to provide a compliant, tacky surface of low energy by coating as above.

The three-dimensional, open cellular structures above may be coated or may be directly reacted to form a compliant, tacky surface of low energy.

The three-dimensional, open cellular structure may itself form a compliant, tacky surface of low energy by, for example, forming such a structure directly from the coating polymers as described above. This is accomplished through methods of forming open-cell polymeric foams known to the art.

The structure may be in the form of sheets, cubes, spheres, or other shapes as well as densities (described by pores per inch and pore size distribution), and levels of tortuosity that optimize surface access, surface area, mineral attachment/detachment kinetics, and durability. These structures may be additionally optimized to target certain mineral particle size ranges, with denser structures acquiring smaller particle sizes. In general, cellular densities may range from 10-200 pores per inch, more preferably 30-90 pores per inch, and most preferably 30-60 pores per inch.

The specific shape or form of the structure may be selected for optimum performance for a specific application. For example, the structure (coated foam for example) may be cut in a variety of shapes and forms. For example, a polymer coated foam belt could be moved through the slurry removing the desired mineral whereby it is cleaned and reintroduced into the slurry. Strips, blocks, and/or sheets of coated foam of varying size could also be used where they are randomly mixed along with the slurry in a mixing cell. Alternatively, a conveyor structure may be formed where the foam is encased in a cage structure that allows a mineral-containing slurry to pass through the cage structure to be introduced to the underlying foam structure where the mineral can react with the foam and thereafter be further processed in accordance with the present invention. The thickness and cell size could be changed to a form cartridge like filter whereby the filter is removed, cleaned of recovered mineral, and reused.

The Related Family

This application is also related to a family of nine PCT applications, which were all concurrently filed on 25 May 2012, as follows:

PCT application no. PCT/US12/39528, entitled "Flotation separation using lightweight synthetic bubbles and beads;"

PCT application no. PCT/US12/39524, entitled "Mineral separation using functionalized polymer membranes;"

PCT application no. PCT/US12/39540, entitled "Mineral separation using sized, weighted and magnetized beads;"

PCT application no. PCT/US12/39576, entitled "Synthetic bubbles/beads functionalized with molecules for attracting or attaching to mineral particles of interest," which corresponds to U.S. Pat. No. 9,352,335;

PCT application no. PCT/US12/39591, entitled "Method and system for releasing mineral from synthetic bubbles and beads;"

PCT application no. PCT/US/39596, entitled "Synthetic bubbles and beads having hydrophobic surface;"

PCT application no. PCT/US/39631, entitled "Mineral separation using functionalized filters and membranes," which corresponds to U.S. Pat. No. 9,302,270;"

PCT application no. PCT/US12/39655, entitled "Mineral recovery in tailings using functionalized polymers;" and PCT application no. PCT/US12/39658, entitled "Techniques for transporting synthetic beads or bubbles In a flotation cell or column," all of which are incorporated by reference in their entirety.

This application also related to PCT application no. PCT/US2013/042202, filed 22 May 2013, entitled "Charged engineered polymer beads/bubbles functionalized with molecules for attracting and attaching to mineral particles of interest for flotation separation," which claims the benefit of U.S. Provisional Patent Application No. 61/650,210, filed 22 May 2012, which is incorporated by reference herein in its entirety.

This application is also related to PCT/US2014/037823, filed 13 May 2014, entitled "Polymer surfaces having a siloxane functional group," which claims benefit to U.S. Provisional Patent Application No. 61/822,679, filed 13 May 2013, as well as U.S. patent application Ser. No. 14/118,984, filed 27 Jan. 2014, and is a continuation-in-part to PCT application no. PCT/US12/39631, filed 25 May 2012, which are all hereby incorporated by reference in their entirety.

This application also related to PCT application no. PCT/US13/28303, filed 28 Feb. 2013, entitled "Method and system for flotation separation in a magnetically controllable and steerable foam," which is also hereby incorporated by reference in its entirety.

This application also related to PCT application no. PCT/US16/57334, filed 17 Oct. 2016, entitled "Opportunities for recovery augmentation process as applied to molybdenum production," which is also hereby incorporated by reference in its entirety.

This application also related to PCT application no. PCT/US16/37322, filed 17 Oct. 2016, entitled "Mineral beneficiation utilizing engineered materials for mineral separation and coarse particle recovery," which is also hereby incorporated by reference in its entirety.

This application also related to PCT application no. PCT/US16/62242, filed 16 Nov. 2016, entitled "Utilizing engineered media for recovery of minerals in tailings stream at the end of a flotation separation process," which is also hereby incorporated by reference in its entirety.

The Scope of the Invention

It should be further appreciated that any of the features, characteristics, alternatives or modifications described regarding a particular embodiment herein may also be applied, used, or incorporated with any other embodiment described herein. In addition, it is contemplated that, while the embodiments described herein are useful for homogeneous flows, the embodiments described herein can also be used for dispersive flows having dispersive properties (e.g., stratified flow).

Although the invention has been described and illustrated with respect to exemplary embodiments thereof, the foregoing and various other additions and omissions may be made therein and thereto without departing from the spirit and scope of the present invention.

What is claimed is:

1. An apparatus, comprising a flotation tank having an input arranged to receive a slurry, the slurry comprises finer mineral particles and coarser mineral particles;

a plurality of bubbles located in the flotation tank arranged to attract the finer mineral particles for providing enriched bubbles having finer mineral particles attached thereon; and a plurality of collection surfaces, the collection surfaces functionalized to be hydrophobic to attract the coarser mineral particles, wherein the flotation tank comprises a tank wall and an interior periphery volume near the tank wall, and the plurality of collection surfaces are disposed in the interior periphery volume to attract the coarser mineral particles, wherein the flotation tank comprises a lower part and an upper part, wherein the input is located in the lower part of the flotation tank and arranged to receive the slurry tangentially to the tank wall, said apparatus further comprising a conduit loop having a first conduit end and a second conduit end, the first conduit end arranged to receive the slurry and the second conduit end arranged to provide the slurry to the input of the flotation tank.

2. The apparatus according to claim 1, wherein said plurality of bubbles comprise air bubbles, said apparatus further comprising an aerator apparatus configured to provide the air bubbles in the lower part of the flotation tank; and an outlet near the upper part of the flotation tank, the outlet arranged to remove the enriched bubbles from the flotation tank.

3. The apparatus according to claim 1, wherein said plurality of bubbles comprise synthetic bubbles having a hydrophobic surface to attract the finer mineral particles, said synthetic bubbles having a specific gravity smaller than the slurry and wherein the enriched bubbles comprise enriched synthetic bubbles having finer mineral particles attached thereon, and an outlet near the upper part of the flotation tank, the outlet arranged to remove the enriched bubbles from the flotation tank.

4. The apparatus according to claim 1, wherein the flotation tank further comprises a central volume surrounded by the interior periphery volume, and wherein the received slurry through the input of the flotation tank has a first slurry part and a second slurry part, the central volume comprising the first slurry part, the interior periphery volume the second slurry part, the first slurry part comprising the finer mineral particle, the second slurry part comprising the coarser mineral particles.

5. The apparatus according to claim 4, wherein the flotation tank further comprises a dividing structure located near the input, the dividing structure arranged to direct the first slurry part to the central volume, and the second slurry part to the interior periphery volume.

6. The apparatus according to claim 1, wherein the collection surfaces comprise wall structures located on an interior side of the tank wall, the wall structures having a surface coated with a hydrophobic material.

7. The apparats according to claim 1, wherein the collection surfaces comprise a layer of foam coated with a hydrophobic material.

8. The apparatus according to claim 1, wherein the collection surfaces comprise one or more conveyor belts having a belt surface coated with a hydrophobic material to attract the coarser mineral particles, wherein each of said one or more conveyor belts is arranged to move through the interior periphery volume to collect the coarser mineral particles on the belt surface; to move to a release tank having a releasing agent configured to strip the coarser mineral particles from the belt surface, and to move through the interior periphery volume again.

9. The apparatus according to claim 1, wherein the collection surfaces comprise one or more baskets having beads coated with a hydrophobic material to attract the coarser mineral particles, wherein each of said one or more baskets is arranged to move through the interior periphery volume to collect the coarser mineral particles on the beads; to move to a release tank having a releasing agent configured to strip the coarser mineral particles from the beads, and to move through the interior periphery volume again.

10. The apparatus according to claim 1, wherein the collection surfaces comprise one or more baskets having filters coated with a hydrophobic material to attract the coarser mineral particles, wherein each of said one or more baskets is arranged to move through the interior periphery volume to collect the coarser mineral particles on the filters; to move to a release tank having a releasing agent configured to strip the coarser mineral particles from the beads, and to move through the interior periphery volume again.

11. The apparatus according to claim 1, wherein the collection surfaces are coated with a chemical selected from the group consisting of polysiloxanes, poly(dimethylsiloxane), hydrophobically-modified ethyl hydroxyethyl cellulose, polysiloxanates, alkylsilane and fluoroalkylsilane.

12. The apparatus according to claim 3, wherein the synthetic bubbles are coated with a chemical selected from the group consisting of polysiloxanes, poly(dimethylsiloxane), hydrophobically-modified ethyl hydroxyethyl cellulose, polysiloxanates, alkylsilane and fluoroalkylsilane.

13. The apparatus according to claim 11, wherein the synthetic bubbles are made of an open-cell foam.

14. The apparatus according to claim 11, wherein the synthetic bubbles have a substantially cubic shape or spherical shape.

15. A method, comprising:

proving a flotation tank having a slurry input arranged to receive a slurry, feeding the slurry which contains finer mineral particles and coarser mineral particles to the flotation tank;

feeding bubbles in a bubble input arranged inside the flotation tank arranged to attract the finer mineral particles and forming enriched bubbles having finer mineral particles attached thereon, the flotation tank comprising a lower part and an upper part, wherein the slurry input is located in the lower part of the flotation tank and arranged to receive the slurry tangentially to the tank wall, proving a plurality of collection surfaces, the collection surfaces functionalized to be hydrophobic to attract the coarser mineral particles, wherein the flotation tank comprises a tank wall and an interior periphery volume near the tank wall, and the plurality of collection surfaces are disposed in the interior periphery volume to attract the coarser mineral particles, arranging a conduit loop having a first conduit end and a second conduit end, feeding the slurry initially to the first conduit end and arranging the second conduit end to provide the slurry to the input of the flotation tank.

16. The method according to claim 15, wherein said plurality of bubbles comprise air bubbles, said method further comprising providing an aerator apparatus configured to provide the air bubbles in the lower part of the flotation tank; and arranging an outlet near the upper part of the flotation tank, the outlet arranged to remove the enriched bubbles from the flotation tank.

17. The method according to claim 16, wherein said plurality of bubbles comprise synthetic bubbles having a hydrophobic surface to attract the finer mineral particles, said synthetic bubbles having a specific gravity smaller than the slurry and wherein the enriched bubbles comprise enriched synthetic bubbles having finer mineral particles attached thereon, said method further comprising arranging an outlet near the upper part of the flotation tank, the outlet arranged to remove the enriched bubbles from the flotation tank.

18. The method according to claim 15, wherein the collection surfaces comprise one or more conveyor belts having a belt surface coated with a hydrophobic material to attract the coarser mineral particles, wherein each of said one or more conveyor belts is arranged to move through the interior periphery volume to collect the coarser mineral particles on the belt surface; to move to a release tank having a releasing agent configured to strip the coarser mineral particles from the belt surface, and to move through the interior periphery volume again.

19. The method according to claim 15, wherein the collection surfaces comprise one or more baskets having beads coated with a hydrophobic material to attract the coarser mineral particles, wherein each of said one or more baskets is arranged to move through the interior periphery volume to collect the coarser mineral particles on the beads; to move to a release tank having a releasing agent configured to strip the coarser mineral particles from the beads, and to move through the interior periphery volume again.

20. The method according to claim 15, wherein the collection surfaces comprise one or more baskets having filters coated with a hydrophobic material to attract the coarser mineral particles, wherein each of said one or more baskets is arranged to move through the interior periphery volume to collect the coarser mineral particles on the filters; to move to a release tank having a releasing agent configured to strip the coarser mineral particles from the beads, and to move through the interior periphery volume again.

* * * * *